United States Patent [19]

Okumura et al.

[11] Patent Number: 4,787,344

[45] Date of Patent: Nov. 29, 1988

[54] TWO-STROKE MULTI-CYLINDER ENGINE

[75] Inventors: Shigeo Okumura; Kyoji Hakamata, both of Hamamatsu, Japan

[73] Assignee: Sanshin Kogyo Kabushiki Kaiisha, Hamamatsu, Japan

[21] Appl. No.: 72,872

[22] Filed: Jul. 14, 1987

[30] Foreign Application Priority Data

Jul. 28, 1986 [JP] Japan ..... 61-175674

[51] Int. Cl.[4] ..... F02B 75/22

[52] U.S. Cl. ..... 123/65 PE; 123/55 R

[58] Field of Search ..... 123/197 A, 65 PE, 65 E, 123/65 A, DIG. 6, DIG. 7, 56 B, 55 V, 55 VE, 55 VF, 55 VS

[56] References Cited

U.S. PATENT DOCUMENTS

| | | | |
|---|---|---|---|
| Re. 26,222 | 6/1967 | Fielder | 123/65 A |
| 1,457,322 | 6/1923 | Sproule | 123/DIG. 6 |
| 2,047,933 | 7/1936 | Allyn | 123/65 A |

*Primary Examiner*—Willis R. Wolfe
*Assistant Examiner*—M. Macy
*Attorney, Agent, or Firm*—Ernest A. Beutler

[57] ABSTRACT

An outboard motor having a V-type crankcase compression internal combustion engine wherein the exhaust ports of each bank are disposed on the same side of the cylinder bore and on a side so as to minimize thermal loading of the skirt of the piston and the problems attended therewith.

2 Claims, 3 Drawing Sheets

TWO-STROKE MULTI-CYLINDER ENGINE

BACKGROUND OF THE INVENTION

This invention relates to a two-stroke multi-cylinder engine and more particularly to an improved porting arrangement for an engine of this type.

Multi-cylinder two-cycle internal combustion engines frequently are constructed so the cylinder bores are disposed in nonaligned relationship. The cylinder bores are placed at an angle to each other (either V-type or opposed-type). It has been the practice to arrange the porting for the engine so that the exhaust ports for one bank lie on the opposite side of the cylinder bore of that bank from the exhaust ports of the other bank. The transfer passages are similarly arranged so that they lie on one side of one bank and the opposite side of the other bank. This is done frequently so as to permit the simplification of the port configuration and the manifolding associated with the exhaust ports.

For example, in V-type engines it is a normal practice to place both of the exhaust ports and the associated exhaust manifolding in the valley of the V. As as result, the transfer passages are grouped on the outside of the banks of the V. Although this provides simplicity of operation, it gives rise to a problem which can be best understood by reference to FIG. 1 which is a showing of the cylinder piston and connecting rod of one of the banks. In a typical configuration, this will be the positioning of the components of the right-hand cylinder bank.

In referring to FIG. 1, the right-hand cylinder bank of a V-type engine is identified by the reference numeral 11 and is formed with one or more cylinder bores 12 in each which a respective piston 13 reciprocates. The piston 13 is connected by means of a piston pin 14 to one end of a connecting rod 15. The opposite end of the connecting rod 15 is journaled upon a throw 16 of a crankshaft 17 for driving the crankshaft 17 upon reciprocation of the piston 13. The piston 13 further has one or more grooves in which piston rings 18 are supported for sealingly engaging the cylinder bore.

An exhaust port 19 opens through one side of the cylinder bore 14, normally the side facing the valley of the V of the engine. This exhaust port 19 is displaced to the left side of the center line of the bore 12 which center line is identified by the reference numeral 21. In a similar manner, one or more transfer passages which terminate in transfer ports 22 are disposed on the opposite (right) side of the cylinder wall 12 from the exhaust port 19.

The piston 13 is driven downwardly by the pressure of the expanding combustion gases under the force P. The angular relationship of the connecting rod 15 in driving the crankshaft 17 in the direction N causes a reactive force F to be directed through the connecting rod that causes a side force H to be exerted on the piston 13. This side force causes the piston 13 to cock slightly in the cylinder bore 12 (shown in exaggerated form in FIG. 1). Because of this cocking, the lower portion of the skirt of the piston 13 is forced into tight engagement with the portion of the cylinder wall 12 surrounding the exhaust port 19. This portion of the cylinder wall is considerably hotter than the intake port side due to the presence of the exhaust port 19 therein. Hence, with a conventional engine there is the danger of a seizure or scuffing of the piston on the cylinder wall.

It is, therefore, a principle object of this invention to provide a multi-cylinder engine in which this condition will not occur.

It is a further object of this invention to provide a multi-cylinder two-cycle crankcase compression internal combustion engine wherein the cylinder banks have their ports arranged in such a manner that the loading of the pistons and thermal conditions thereon are the same from one bank to another.

SUMMARY OF THE INVENTION

This invention is adapted to be embodied in an internal combustion engine having a pair of cylinder bores that are disposed at an angle to each other. Pistons reciprocate in the cylinder bores and are connected by means of connecting rods to a crankshaft for rotatably driving the crankshaft. The connection between the pistons and the connecting rods is such that a side thrust is exerted on the pistons which cause the pistons to tilt in the cylinder bore. An exhaust port opens into the cylinder bore at one side thereof and in accordance with the invention each of the exhaust ports open through the same side of the respective cylinder bore as the other.

DESCRIPTION OF THE PREFERRED EMBODIMENT OF THE INVENTION

Figure 2:
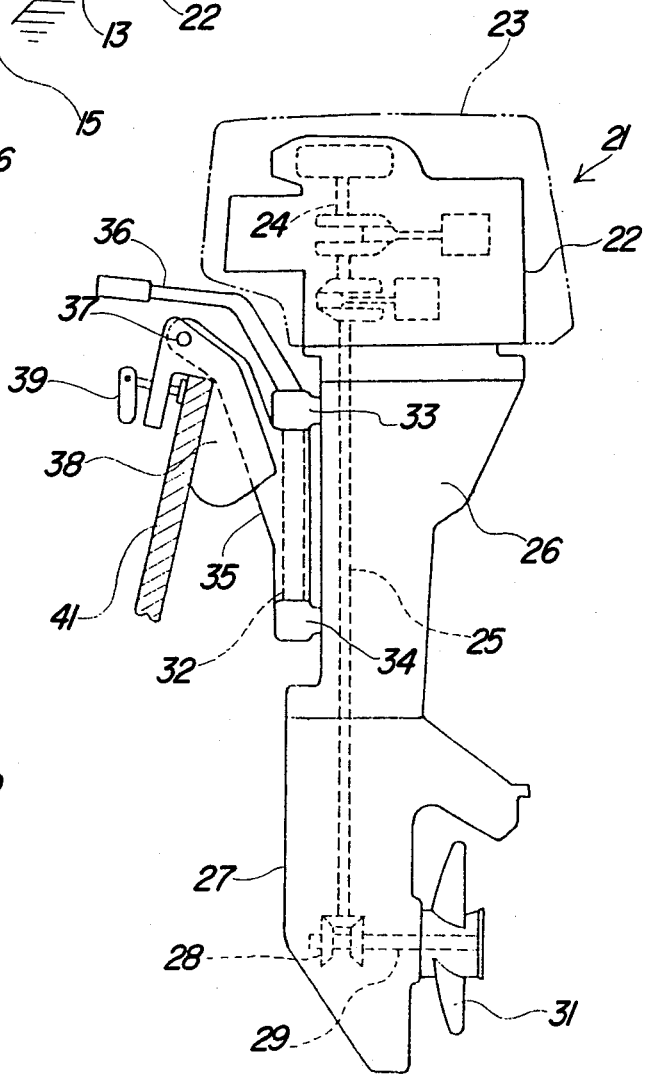
FIG. 2 is a side elevational view of an outboard motor constructed in accordance with an embodiment of the invention.

Referring first to FIG. 2, an outboard motor, which comprises a typical embodiment in which the invention may be practiced, is identified generally by the reference numeral 21. The outboard motor 21 includes a power head comprised of a powering internal combustion engine 22 and a surrounding protective cowling, which is shown in phantom and identified by the reference numeral 23. The engine 22, in accordance with normal outboard motor practice, has its crankshaft 24 supported for rotation about a vertically extending axis and coupled to a drive shaft 25 which is journaled within a drive shaft housing 26. The drive shaft housing 26 is affixed to the power head and particularly the engine 22 in a known manner. A lower unit 27 is positioned beneath the drive shaft housing 26 and contains a forward, neutral, reverse transmission 28 of a known type for driving a propeller shaft 29 and associated propeller 31.

A steering shaft 32 is affixed to the drive shaft housing 26 as by upper and lower brackets 33 and 34. The steering shaft 32 is journaled within a swivel bracket 35 for steering of the outboard motor 21. A tiller 36 is affixed to the upper end of the steering shaft 32 for this purpose.

The swivel bracket 35 is pivotally connected by means of a pivot pin 37 to a clamping bracket 38. The clamping bracket 38 carries a clamping device 39 for attachment to a transom 41 of an associated watercraft.

It is to be understood that the construction of the outboard motor, as aforenoted, is only typical of the environment in which the invention may be practiced. For that reason, the details of the construction of the outboard motor 21 may be considered to be conventional and are not necessary to understand the construction and operation of the engine.

Figure 3:
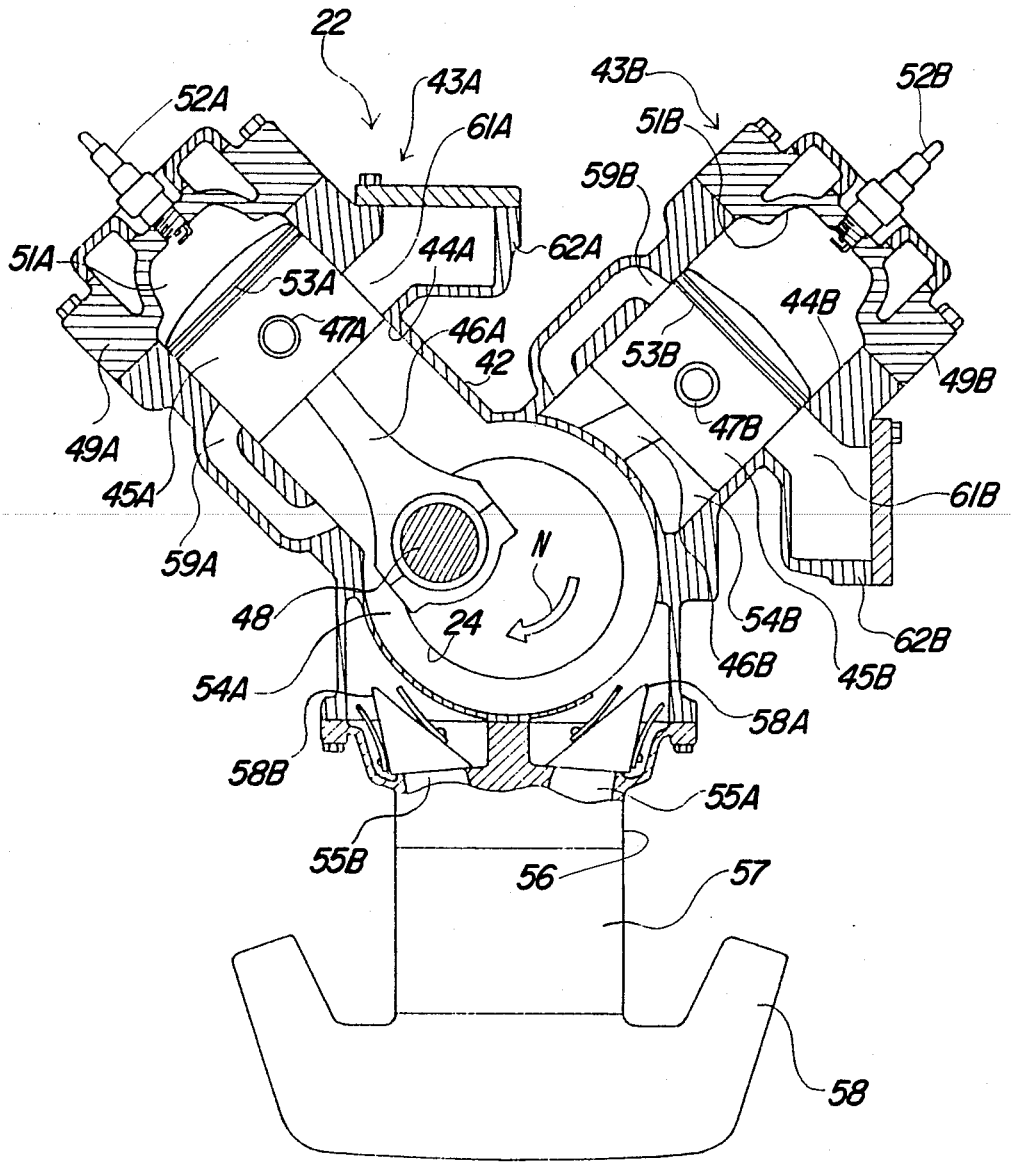
FIG. 3 is a cross-sectional view taken through the engine of the outboard motor shown in FIG. 2.

Referring now to FIG. 3, the engine 22 is shown in cross section taken through a horizontal plane passing through the cylinder bore of one of the cylinder banks. In the illustrated embodiment, the engine 22 is of the V4 configuration. However, the invention may be practiced in conjunction with engines having different numbers of cylinders or with the cylinder banks disposed at a different angle to each other than a V angle, such as an opposed engine.

The engine 22 includes a cylinder block 42 that defines respective cylinder banks 43A and 43B. It should be noted that the components of the cylinder banks 43A and 43B are substantially identical in construction and therefore the same reference numerals have been applied to the components of each bank with those of the left-hand bank being identified by the suffix A and those of the right-hand bank identified by the suffix B. Each cylinder bank is formed with one or more cylinder bores 44 in which respective pistons 45 reciprocate. Connecting rods 46 are connected at their upper ends by means of piston pins 47 to the respective pistons 45. Lower ends of the connecting rods 46 are journaled on throws 48 of the crankshaft 24.

The cylinder heads 49 are affixed to the respective cylinder banks 43 and define cavities or recesses 51 which cooperate with the cylinder bores 44 and pistons 45 to form the combustion chambers of the engine. Spark plugs 52, which are fired in a known manner, are supported in the cylinder heads 49 for firing the charge in the respective combustion chambers 51.

Pistons 45 carry respective piston rings 53 for achieving sealing with the cylinder bores. However, it should be noted, as is normal engine practice, that there is some clearance between the pistons 45 and the cylinder bores 44.

Since the engine 22 operates on the two-cycle crankcase compression principle, the crankcase chambers 54 associated with each of the combustion chambers 51 are sealed from each other. A fuel air charge is delivered to each of these sealed chambers through intake passages 55 of an intake manifold 56. One or more carburetors 57 deliver a fuel air charge to the manifold passages 55. Reed-type check valves 58 are provided at the point where the manifold passages 55 communicate with the crankcase chambers 54 so as to prevent any reverse flow. An air inlet device 58 supplies silenced air to the carburetors 57.

In accordance with the invention, transfer or scavenge ports 59 are provided on the same side of the respective cylinder bores the banks 43A and 43B. In a similar manner, exhaust ports 61 are formed on the same side of the cylinders of the banks 43A and 43B. The exhaust ports 61 communicate with respective exhaust manifolds 62 which also lie on the same sides of the cylinder banks.

Figure 1:
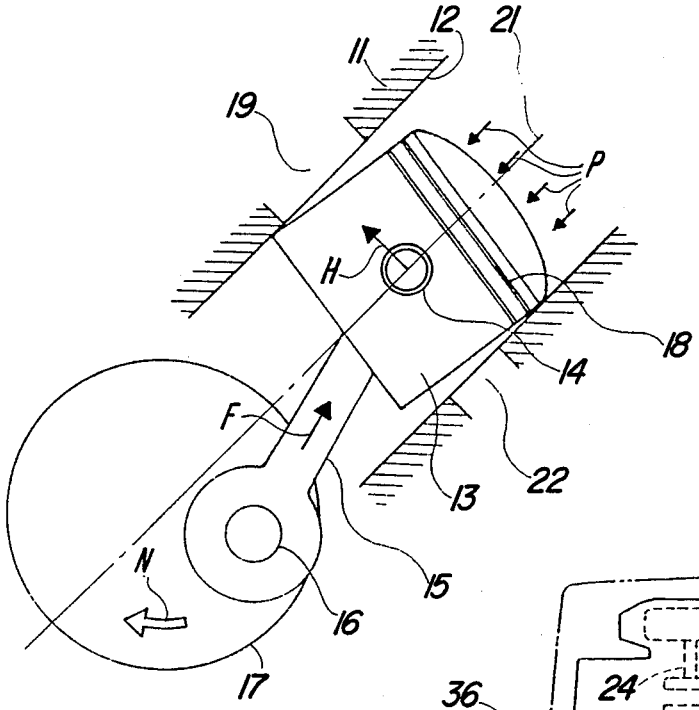
Fig-1 PRIOR ART
FIG. 1 is a schematic cross-sectional view taken through a right bank cylinder bore of an internal combustion engine of the V-type and constructed in accordance with a prior art type of arrangement.
Figure 4:
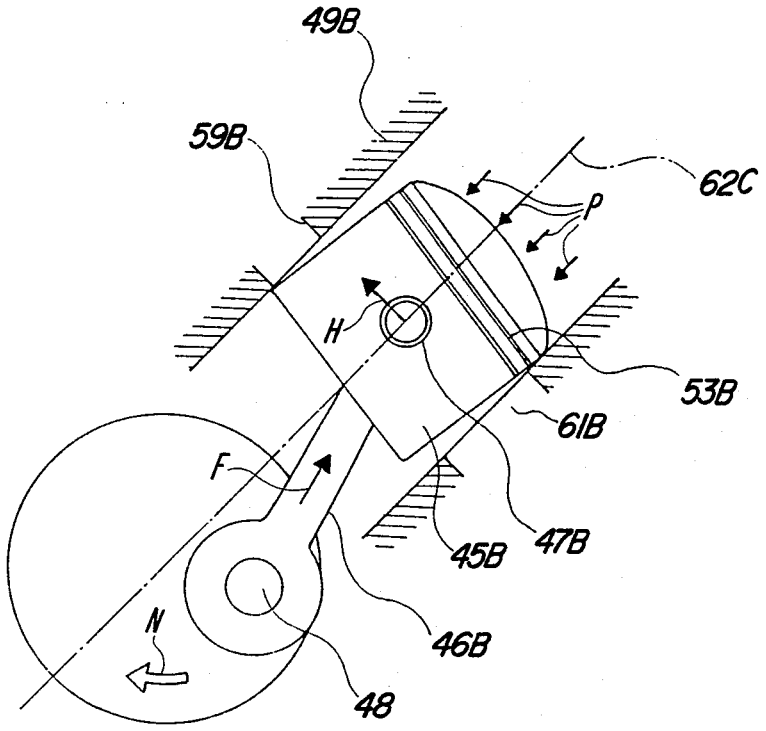
FIG. 4 is a vector diagram, in part similar to FIG. 1, showing the conditions on the cylinders in the right-hand bank of the instant embodiment of the invention.

FIG. 4 is a vector diagram of the right-hand bank of the engine constructed in accordance with the embodiment of the invention. It may be seen, the positioning of the exhaust port 61B of this cylinder bank places it on the side of the cylinder bore axis 62C that is to the right-hand side of this figure. Accordingly, the head of the piston rather than the skirt will be pressed toward the top walls surrounding the exhaust port 62A. Because the head of the piston has substantially greater mass, the effect of heating will be rapidly dissipated and there will not be the scuffing that results in connection with conventional engines of the type as shown in FIG. 1. Hence, the engine will operate much better and have a longer and trouble-free life than conventional engines not embodying the invention.

It should be readily apparent that the foregoing description is only that of a preferred embodiment of the invention and that various changes and modifications may be made without departing from the spirit and scope of the invention, as defined by the appended claims.

We claim:

1. In an internal combustion engine having a pair of cylinder bores disposed at an angle to each other, pistons reciprocating in said cylinder bores, a crankshaft supported for rotation about an axis relative to said cylinder bores, connecting rods for transferring reciprocation of said pistons into rotation of said crankshaft, the connection between said pistons and said connecting rods being such that a side thrust is exerted on said pistons for causing said pistons to tilt in said cylinder bores during the power strokes of the pistons, and exhaust ports opening into said cylinder bores at one side of a plane passing through the respective cylinder bore axis and parallel to the crankshaft rotational axis, the improvement comprising each of said exhaust ports opening through the same side of the respective plane with respect to the direction of rotation of said crankshaft.

2. An internal combustion engine as defined in claim 1 wherein the exhaust ports open into the side of the cylinder bores so that the skirt of the pistons are tilted away from the exhaust ports during the power strokes of the pistons.

* * * * *